US010690128B2

(12) United States Patent
Hodges

(10) Patent No.: US 10,690,128 B2
(45) Date of Patent: Jun. 23, 2020

(54) PERISTALTIC PUMPS

(71) Applicant: Hodges & Drake Design Limited, Leicester (GB)

(72) Inventor: Kevin Hodges, Leicester (GB)

(73) Assignee: HODGES & DRAKE DESIGN LIMITED, Leicester, Leicestershire (GB)

( * ) Notice: Subject to any disclaimer, the term of this patent is extended or adjusted under 35 U.S.C. 154(b) by 206 days.

(21) Appl. No.: 15/533,696

(22) PCT Filed: Dec. 10, 2015

(86) PCT No.: PCT/GB2015/053777

§ 371 (c)(1),
(2) Date: Jun. 7, 2017

(87) PCT Pub. No.: WO2016/092307

PCT Pub. Date: Jun. 16, 2016

(65) Prior Publication Data

US 2017/0321686 A1 Nov. 9, 2017

(30) Foreign Application Priority Data

Dec. 10, 2014 (GB) ..... 1421964.6

(51) Int. Cl.
*F04B 43/12* (2006.01)
*F04B 43/00* (2006.01)

(52) U.S. Cl.
CPC ..... *F04B 43/1276* (2013.01); *F04B 43/0072* (2013.01); *F04B 43/1253* (2013.01); *F04B 43/1261* (2013.01)

(58) Field of Classification Search
None
See application file for complete search history.

(56) References Cited

U.S. PATENT DOCUMENTS 2,251,235 A * 7/1941 Weydell ..... F04B 43/0072 418/45
2,583,572 A * 1/1952 Huber ..... F04C 5/00 418/56

(Continued)

FOREIGN PATENT DOCUMENTS

DE 8316229 U1 10/1983
DE 3320091 A1 12/1984

(Continued)

OTHER PUBLICATIONS

ISA/EP, International Search Report and Written Opinion for PCT patent application No. PCT/GB2015/053777, dated Aug. 3, 2016.

(Continued)

*Primary Examiner* — Peter J Bertheaud
*Assistant Examiner* — Geoffrey S Lee
(74) *Attorney, Agent, or Firm* — NK Patent Law

(57) ABSTRACT

A peristaltic pump (10) comprises a drivable rotor (14), having at least one pressing member (15), and a cylindrical stator (12) in which the rotor (14) is rotatable. Flexible tubing (22), having an inlet side (24) and an outlet side (26), extends circumferentially around the cylindrical stator (12) against an inner wall (12*a*). The peristaltic pump (10) includes a radially deformable ring (28) positioned between the rotor (14) and the circumferentially extending flexible tubing (22). The ring (28) is deformed by the pressing member (15) upon rotation of the rotor (14) and this compresses the flexible tubing (22) against the inner wall (12*a*) of the cylindrical stator (12) to convey liquid along the flexible tubing (22). The radially deformable ring (28) includes a ring anchor (30) which prevents rotation of the radially deformable ring (28) during rotation of the rotor (14).

16 Claims, 7 Drawing Sheets

(56) References Cited

U.S. PATENT DOCUMENTS 2,899,905 A * 8/1959 Becker ..... F04B 43/1253 417/475
2,899,906 A * 8/1959 Becher ..... F04B 43/0072 417/477.12
2,899,907 A * 8/1959 Becker ..... F04B 43/1253 417/477.6
2,925,045 A * 2/1960 Mascaro ..... F04B 43/0072 417/477.14
3,421,447 A * 1/1969 Idoine ..... F04B 43/1253 417/477.14
3,554,674 A * 1/1971 Huret ..... B01L 3/0293 417/475
4,138,205 A 2/1979 Wallach
4,288,205 A 9/1981 Henk
4,540,350 A * 9/1985 Streicher ..... F04B 43/1253 417/475
4,545,744 A * 10/1985 Weber ..... F04B 43/1276 417/475
4,576,556 A * 3/1986 Thompson ..... F04B 43/1253 417/477.12
6,036,459 A * 3/2000 Robinson ..... F04B 43/1269 417/477.11
6,171,082 B1 * 1/2001 Hankner ..... F04B 43/0072 138/177
7,645,127 B2 * 1/2010 Hagen ..... F04B 43/1253 417/477.1
7,654,803 B2 * 2/2010 Harada ..... B41J 2/17596 417/477.11
8,147,223 B2 * 4/2012 Harada ..... B41J 2/17596 417/477.11
10,151,309 B2 * 12/2018 McIntyre ..... F04B 43/1238
10,226,565 B2 * 3/2019 Fini ..... A61M 39/10
2006/0177329 A1 * 8/2006 Firmann ..... F04B 43/0072 417/477.9
2006/0245964 A1 * 11/2006 Koslov ..... F04B 43/1253 417/477.1
2011/0058969 A1 3/2011 Ramirez, Jr. et al.
2016/0000988 A1 * 1/2016 Fini ..... A61M 39/10 137/565.01
2017/0268496 A1 * 9/2017 McIntyre ..... F04B 43/1238
2019/0143015 A1 * 5/2019 Heide ..... A61M 1/1086 604/6.11

FOREIGN PATENT DOCUMENTS

GB 785597 A 8/1956
GB 2256462 A 12/1992
GB 0013261 A 5/2000
WO 8805868 A2 8/1988
WO 9410446 A1 5/1994

OTHER PUBLICATIONS

ISA/UK, International Search Report for patent application No. GB1521748.2, dated Jun. 17, 2016.
Federal Service on Intellectual Property, Search Report in International Application No. 2017123813 dated Jun. 3, 2019.

* cited by examiner

PERISTALTIC PUMPS

TECHNICAL FIELD

The present disclosure relates generally to peristaltic pumps.

TECHNICAL BACKGROUND

Peristaltic pumps are used to pump liquids in a wide variety of applications, in particular where the flow of liquid needs to be carefully metered and where contamination of the liquid needs to be avoided. They are extensively used in medical applications, for example to deliver intravenous (IV) liquids to a patient, and also in food and beverage applications, for example to dispense a predetermined quantity of a beverage or a component of a beverage such as a liquid flavouring.

In a conventional peristaltic pump, flexible tubing is compressed between the pressing members (e.g. pins or rollers) of a rotor and a stator, and liquid is conveyed through the flexible tubing as the rotor rotates. The friction between the pressing members and the tubing can, however, cause a number of problems, notably premature wear of the flexible tubing, and the present disclosure seeks to address this.

SUMMARY OF THE DISCLOSURE

According to a first aspect of the present disclosure, there is provided a peristaltic pump comprising:

- a drivable rotor having at least one pressing member;
- a cylindrical stator in which the rotor is rotatable;
- flexible tubing having an inlet side and an outlet side, the flexible tubing extending circumferentially around the stator against an inner wall;
- a radially deformable ring positioned between the rotor and the circumferentially extending flexible tubing, the ring being deformable by the at least one pressing member upon rotation of the rotor to compress the flexible tubing against the inner wall of the cylindrical stator to thereby convey liquid along the flexible tubing;
- wherein the radially deformable ring includes a ring anchor for preventing rotation of the radially deformable ring during rotation of the rotor.

According to a second aspect of the present disclosure, there is provided a method for assembling a peristaltic pump according to the first aspect, the method comprising:

- locating the flexible tubing circumferentially around the radially deformable ring and in contact therewith, with the inlet side and the outlet side of the flexible tubing arranged side-by-side on either side of the ring anchor;
- positioning the flexible tubing and the radially deformable ring in the cylindrical stator with the flexible tubing arranged against the inner wall of the cylindrical stator; and
- fitting the rotor in the cylindrical stator by simultaneously rotating the rotor and pressing the rotor into the centre of the radially deformable ring.

The term 'liquid' as used in this specification is intended to include liquid and semi-liquid products.

The rotor may include a plurality of pressing members and the pressing members may be equispaced around the circumference of the rotor. The rotor may include a spindle.

The spindle and the or each pressing member may be integrally formed. The or each pressing member may be a lobe.

In one embodiment, the or each lobe may have an arcuate pressing surface which may be arranged to progressively compress the flexible tubing against the inner wall of the cylindrical stator during rotation of the rotor. The or each lobe may have an apex at which the arcuate pressing surface terminates, and the apex may be arranged to fully compress the flexible tubing against the inner wall of the cylindrical stator. The rotor may include two of said lobes at diametrically opposite locations.

In a conventional peristaltic pump, the flexible tubing is subjected to high rates of wear because of the friction forces applied by the pressing members during rotation of the rotor. It is, therefore, generally necessary to use expensive high-grade flexible tubing that can withstand the high friction forces to avoid premature wear of the flexible tubing. In the peristaltic pump according to the present disclosure, the radially deformable ring prevents direct contact between the pressing members and the flexible tubing, the radial compression force instead being applied to the flexible tubing by the radially deformable ring. As a result, the flexible tubing does not wear out during operation of the pump. In addition, the flexible tubing is not stretched or pinched because the radially deformable ring is held stationary by the ring anchor. This means that lower grade (and, therefore, less expensive) flexible tubing can typically be used.

The rotor may be engageable by an external rotary drive. With this arrangement, the peristaltic pump is easy and cheap to manufacture and can be readily provided as a disposable system. In particular, because the rotary drive is a separate component that engages the rotor of the peristaltic pump, the peristaltic pump has a simple and inexpensive construction which can, for example, be formed integrally with or attached to a liquid container and which can be disposed of with the liquid container, for example when the container is empty.

The inlet side and the outlet side of the flexible tubing may be arranged side-by-side, at circumferentially adjacent positions on the cylindrical stator, so that the flexible tubing may extend in a substantially radial direction outwardly away from the cylindrical stator. The ring anchor may project radially outwardly from the deformable ring and may be located between the inlet side and the outlet side of the flexible tubing. The ring anchor may be gripped between the inlet side and the outlet side of the flexible tubing. The ring anchor may comprise a finger projecting radially outwardly from the radially deformable ring. This arrangement provides a convenient way to prevent rotation of the radially deformable ring.

The radially deformable ring may have an axial depth which is greater than an outer diameter of the flexible tubing.

The radially deformable ring may include a plurality of circumferentially-spaced radial projections on a first axial rim which may project in a radially outward direction towards the inner wall of the cylindrical stator. The radial projections may help to axially retain the flexible tubing on the radially deformable ring, in particular whilst the flexible tubing and the radially deformable ring are being positioned in the cylindrical stator during assembly of the peristaltic pump.

The rotor may include a circular flange which may axially retain the flexible tubing and the radially deformable ring in the cylindrical stator. In an embodiment, the radially deformable ring may be arranged in the stator with the radial projections in contact with the circular flange. In this embodiment, the radial projections act as plain bearing members and space the flexible tubing from the axially inner surface of the rotating circular flange. This reduces friction forces between the rotating circular flange and the static flexible tubing as the rotor rotates and prevents the flexible tubing from being gripped and stretched by the circular flange during rotation of the rotor.

The radially deformable ring may include a locating arrangement. The locating arrangement may be provided on a second axial rim. The locating arrangement may extend from the ring anchor over the inlet side and the outlet side of the flexible tubing. The locating arrangement may comprise a locating flange or may alternatively comprise a pair of oppositely extending locating projections.

The radially deformable ring may include locating members which may provide for axial location of the flexible tubing on the radially deformable ring. The locating members may be provided on first and second rims at axially opposite ends of the radially deformable ring. The locating members ensure that the flexible tubing is retained axially on the radially deformable ring, in particular whilst the flexible tubing and radially deformable ring are being positioned in the cylindrical stator during assembly of the peristaltic pump.

The locating members may include a plurality of circumferentially-spaced locating projections, which may project in a radially outward direction, on the first rim. The locating projections may be equally spaced around the first rim. The locating members may include a locating flange, on the second rim, which extends from the ring anchor over the inlet side and the outlet side of the flexible tubing.

DETAILED DESCRIPTION OF EMBODIMENTS

Figure 1:
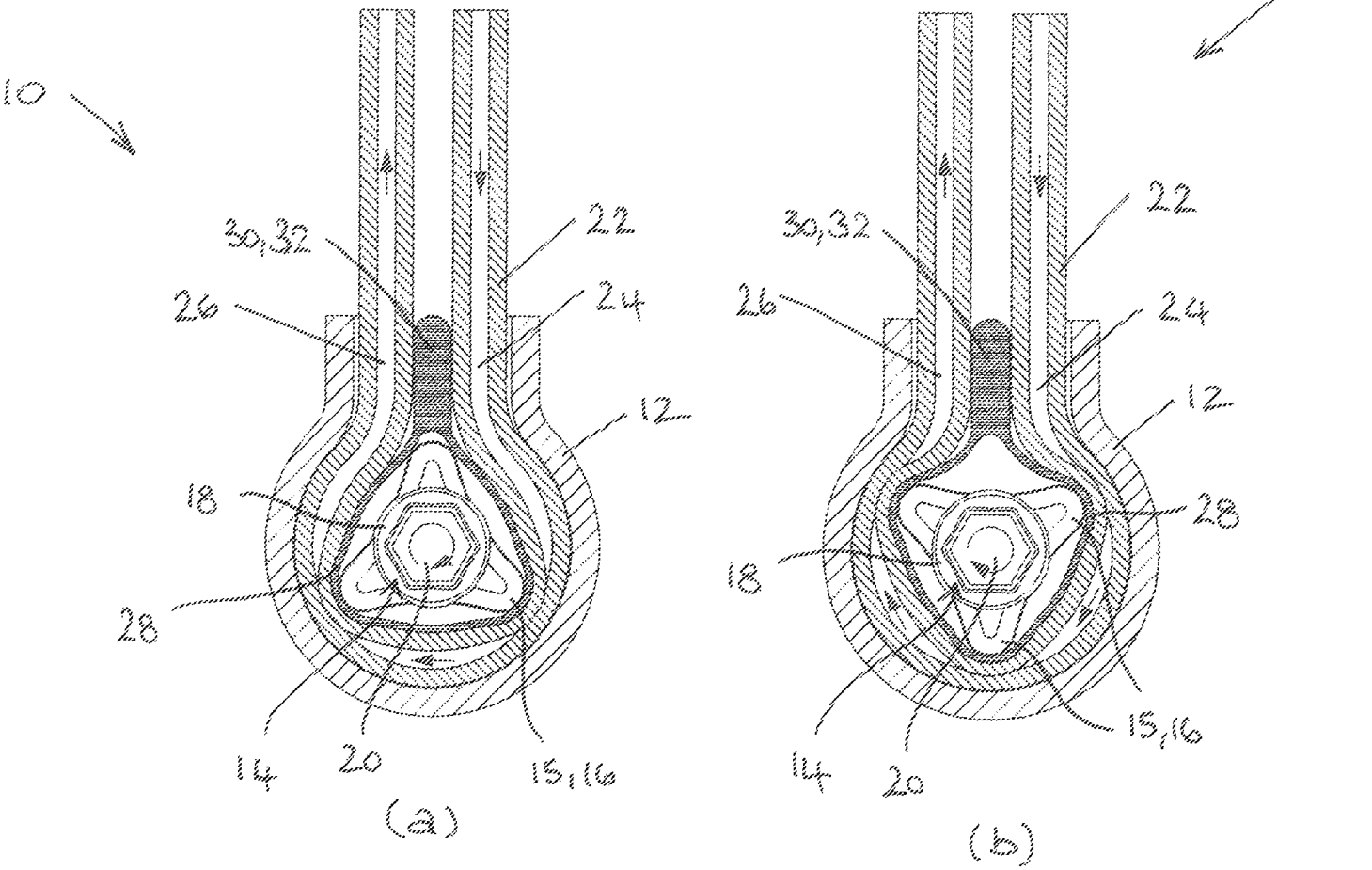
FIGS. 1*a* and 1*b* are cross-sectional views of a peristaltic pump according to a first embodiment of the present disclosure with the rotor at different rotational positions.
Figure 2:
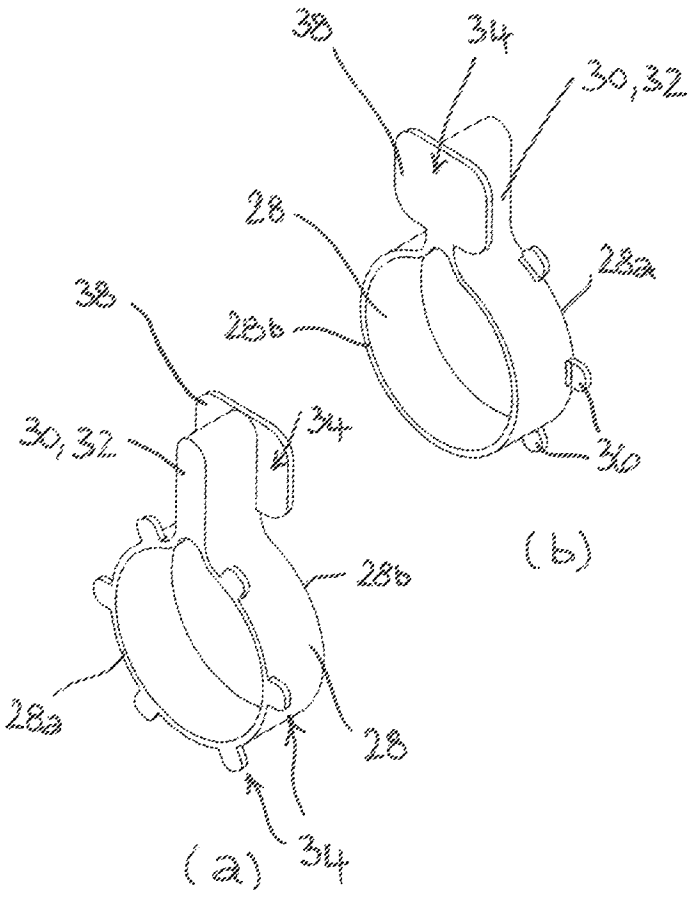
FIGS. 2*a* and 2*b* are perspective views showing the detail of the radially deformable ring shown in FIGS. 1*a* and 1*b;*

Embodiments of the present disclosure will now be described by way of example only and with reference to the accompanying drawings.

A peristaltic pump 10, 50 includes a cylindrical stator 12. Although not shown, the cylindrical stator 12 can be integrally formed, for example as a one-piece moulding, with a liquid container from which liquid is to be dispensed or can be removably mountable on a liquid container.

FIGS. 1 to 5 illustrate a first embodiment of a peristaltic pump 10 which includes a rotor 14 (best seen in FIG. 5), typically formed of a moulded substantially rigid plastics material. The rotor 14 includes a plurality of pressing members 15 in the form of lobes 16 which are integrally formed with, and project radially outwardly from, a spindle 18 and which are equally spaced around the circumference of the spindle 18. In the illustrated embodiment, the rotor 14 includes three lobes 16 but it will be appreciated that the rotor 14 can include any suitable number of lobes 16. The spindle 18 includes a central drive aperture 20 which can be engaged by an external rotary drive (not shown) such as the drive shaft of an electric motor.

The peristaltic pump 10 includes flexible tubing 22 which can be formed of any suitable resilient plastics material such as polyvinyl chloride. The flexible tubing 22 has an inlet side 24 through which liquid is delivered to the peristaltic pump 10 and an outlet side 26 through which liquid is delivered from the peristaltic pump 10. The inlet side 24 and outlet side 26 are designated with respect to the normal direction of rotation of the rotor 14 (clockwise in the accompanying drawings). The inlet side 24 is typically connected to a liquid outlet port of a liquid container (not shown) and the outlet side 26 is arranged to deliver the liquid to a desired location. The flexible tubing 22 extends circumferentially around the cylindrical stator 12 against an inner wall 12*a* and the inlet side 24 and the outlet side 26 are arranged side-by-side, at circumferentially adjacent positions around the cylindrical stator 12. The inlet side 24 and the outlet side 26 extend outwardly away from the cylindrical stator 12 in a substantially radial direction.

A radially deformable ring 28, comprising a suitable resiliently deformable material (typically a plastics material), is positioned between the rotor 14 and the circumferentially extending flexible tubing 22. The deformable ring 28 is contacted by the lobes 16 of the rotor 14 as best seen in FIGS. 1*a* and 1*b* and is deformed radially outwardly by the lobes 16. The radially outward deformation of the deformable ring 28 compresses the flexible tubing 22 against the inner wall 12*a* of the cylindrical stator 12 and, thus, as the rotor 14 is rotated by an external rotary drive, the compression of the flexible tubing 22 between the deformable ring 28 and the inner wall 12*a* conveys liquid along the flexible tubing 22 by peristaltic action, between the inlet side 24 and the outlet side 26. Although the liquid is normally conveyed from the inlet side 24 to the outlet side 26 of the flexible tubing (by rotating the rotor 14 in the clockwise direction as viewed in FIGS. 1*a* and 1*b*), the flow direction can be easily reversed and it will be understood that the desired flow direction can be selected by simply selecting a clockwise or anti-clockwise direction of rotation for the external rotary drive.

The deformable ring 28 includes a ring anchor 30 in the form of a finger 32 which projects radially from the deformable ring 22. The ring anchor 30 is located between the inlet side 24 and the outlet side 26 of the flexible tubing 22 and has a sufficient length (in the radially outward direction) and width (in the circumferential direction) that it cannot move out of its position between the inlet side 24 and the outlet side 26 of the flexible tubing 22. Thus, it will be understood that the ring anchor 30 prevents the deformable ring 28 from being rotated by the rotor 14 as the rotor 14 rotates in the cylindrical stator 12. If the ring anchor 30 was not provided, the deformable ring 28 would be caused to rotate by the rotor 14 and this would result in unwanted stretching and wearing of the flexible tubing 22 between the deformable ring 28 and the inner wall 12*a* of the cylindrical stator 12.

Figures 3, 4, 5:
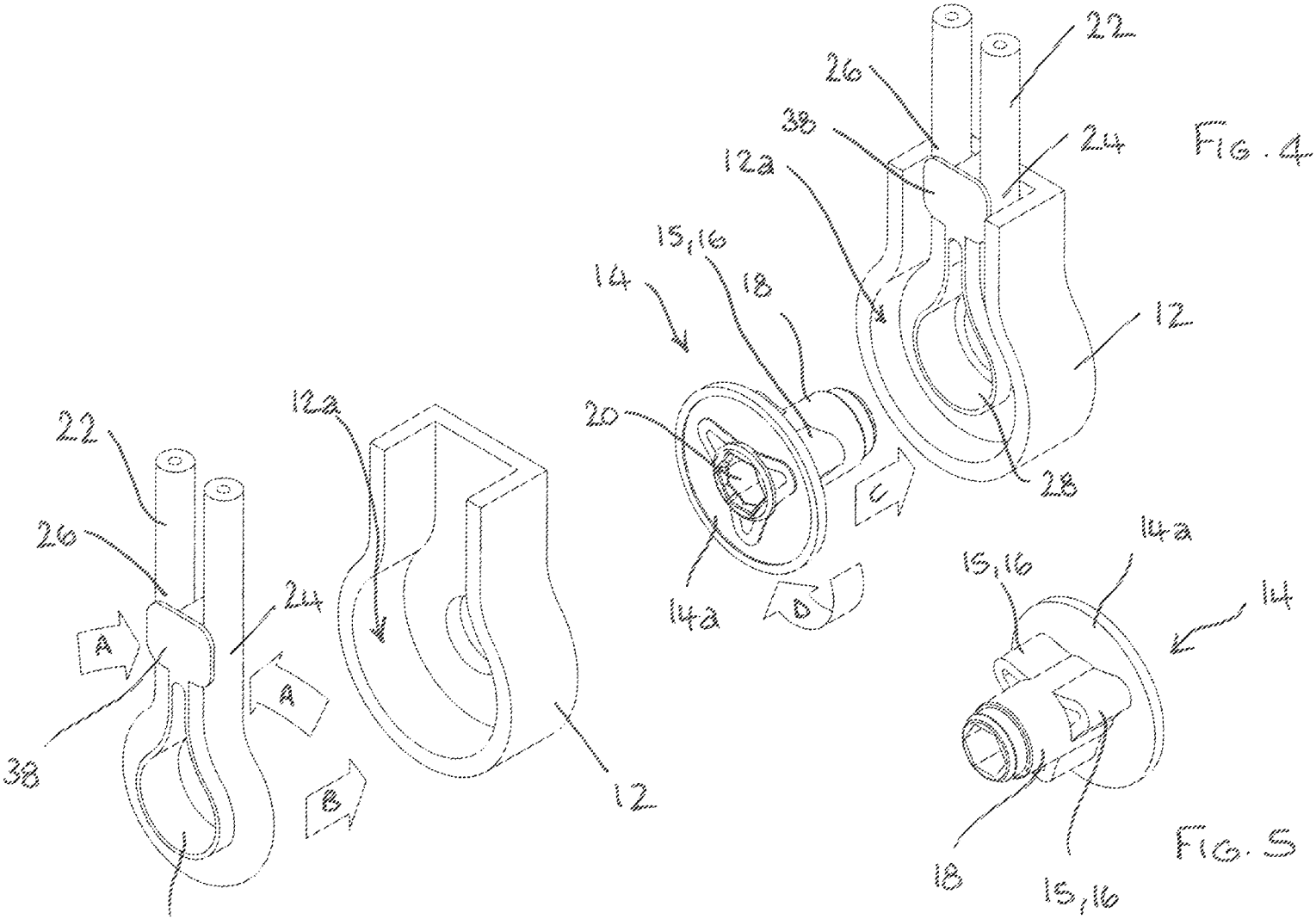
FIG. 3 is a perspective view showing the flexible tubing located around the radially deformable ring before being positioned in the cylindrical stator.
FIG. 4 is a perspective view showing the flexible tubing and radially deformable ring positioned in the cylindrical stator before the rotor is fitted in the cylindrical stator.
FIG. 5 is a detailed view of the rotor.
Figure 6:
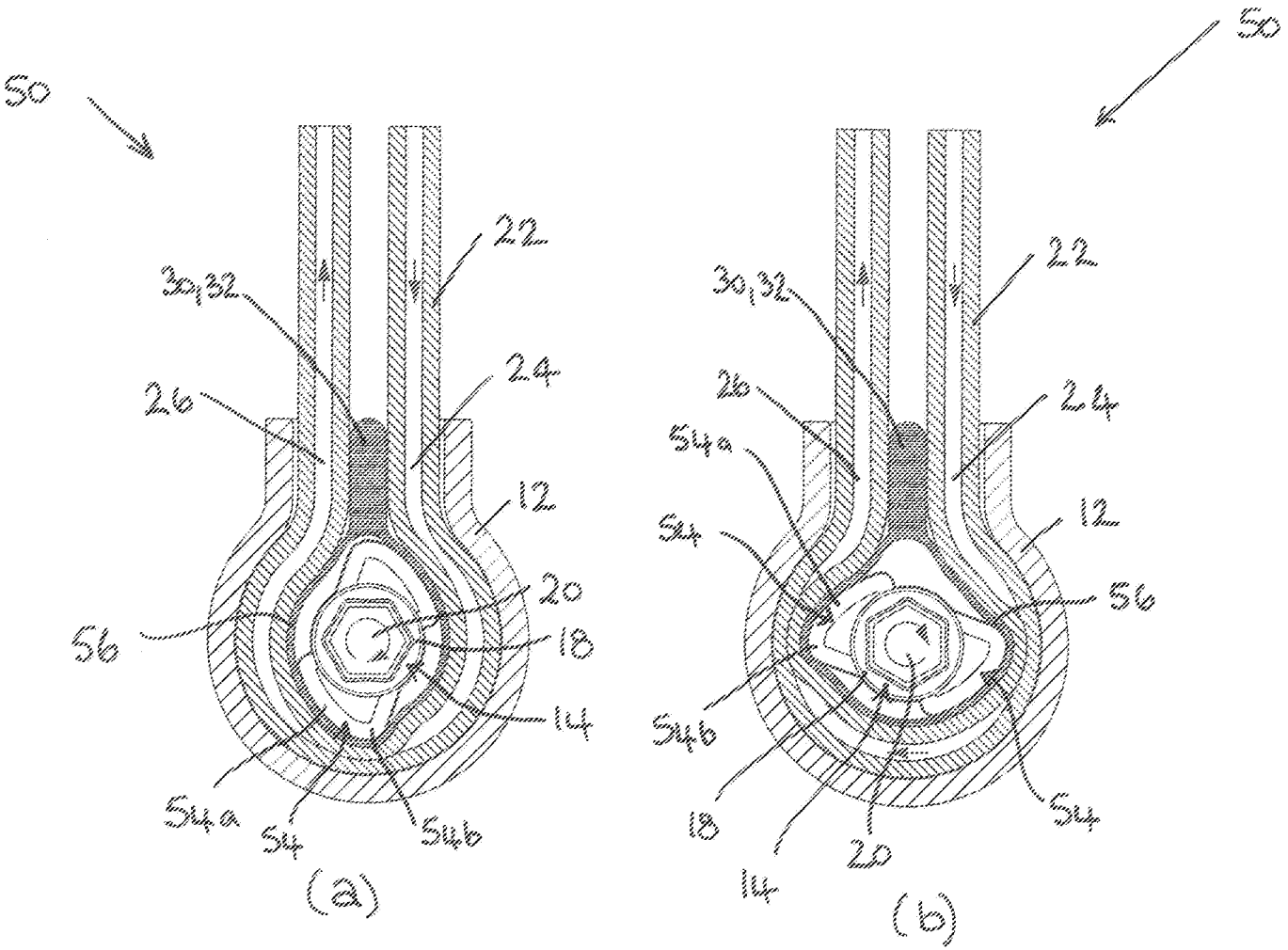
FIGS. 6*a* and 6*b* are cross-sectional views of a peristaltic pump according to a second embodiment of the present disclosure with the rotor at different rotational positions.

As best seen in FIG. 3, the deformable ring 28 has an axial depth which is greater than the outer diameter of the flexible tubing 22. In order to assist with the assembly of the peristaltic pump 10, the deformable ring 28 includes a plurality of locating members 34 which help to locate the flexible tubing 22 around the deformable ring 28 and prevent the flexible tubing 22 from slipping axially off the deformable ring 28.

In the illustrated embodiment, the locating members 34 comprise a plurality of locating projections 36 on a first rim 28*a* of the deformable ring 28. The locating projections 36 project radially outwardly by a small distance from the deformable ring 28, in use towards the inner wall 12*a* of the cylindrical stator 12, and are typically provided at equispaced positions around the circumference of the first rim 28*a*. The locating members 34 additionally comprise a locating flange 38, on the second rim 28*b*, which extends sideways from the ring anchor 30 over the inlet side 24 and the outlet side 26 of the flexible tubing 22. Thus, it will be understood that the locating projections 36 prevent the flexible tubing 22 from slipping axially of the first rim 28*a* of the deformable ring 22 and that the locating flange 38 helps to prevent the flexible tubing 22 from slipping axially off the second rim 28*b*, in the opposite direction.

The method of assembling the peristaltic pump 10 will now be described with reference to FIGS. 3 and 4. Initially, the flexible tubing 22 is located around the deformable ring 28 so that it contacts the radially outer surface of the deformable ring 28 and so that the inlet side 24 and the outlet side 26 of the flexible tubing 22 are arranged side-by-side on either side of the ring anchor 30. As will be understood, the locating projections 36 and locating flange 38 help the user to locate the flexible tubing 22 around the deformable ring 28 and prevent the flexible tubing 22 from slipping axially off the deformable ring 28 during assembly. The assembled flexible tubing 22 and deformable ring 28 are then compressed, for example by squeezing as shown diagrammatically by the arrows A, to a sufficient size to enable them to be pushed into the cylindrical stator 12 in the direction of the arrow B.

Once the flexible tubing 22 and deformable ring 28 have been positioned in the cylindrical stator 12 as shown in FIG. 4, the rotor 14 can be fitted and this is achieved by pushing the rotor 14 into the centre of the deformable ring 28, as shown diagrammatically by the arrow C, and at the same time rotating the rotor 14 by a small amount as shown diagrammatically by the arrow D. Once the rotor 14 has been fitted into the centre of the deformable ring 28, the circular flange 14*a* may also help to retain the flexible tubing 22 in the correct position inside the cylindrical stator 12.

Once assembled, the central drive aperture 20 can be engaged by an external rotary drive which can be operated to rotate the rotor 14.

Referring now to FIGS. 6 to 12, there is shown a second embodiment of a peristaltic pump 50. The peristaltic pump 50 shares many features in common with the peristaltic pump 10 illustrated in FIGS. 1 to 5 and corresponding features are designated using corresponding reference numerals. The differences between the peristaltic pumps 10, 50 will now be explained.

The peristaltic pump 50 includes a rotor 52 (best seen in FIG. 11) which includes two diametrically opposed lobes 54 that are integrally formed with, and project radially outwardly from, the spindle 18. As best seen in FIGS. 6*a* and 6*b*, each lobe 54 has a curved or arcuate pressing surface 54*a* whose radius relative to the spindle axis increases gradually and smoothly. The pressing surface 54*a* progressively compresses the flexible tubing 22 against the inner wall 12*a* of the cylindrical stator 12 as the rotor 52 rotates in the cylindrical stator 12 in the clockwise direction. Each lobe 54 also has an apex 54*b* at which the pressing surface 54*a* terminates and it will be apparent from FIGS. 6*a* and 6*b* that each apex 54*b* is arranged to fully compress the flexible tubing 22 against the inner wall 12*a* of the cylindrical stator 12 to achieve the required peristaltic pumping action.

Figure 8:
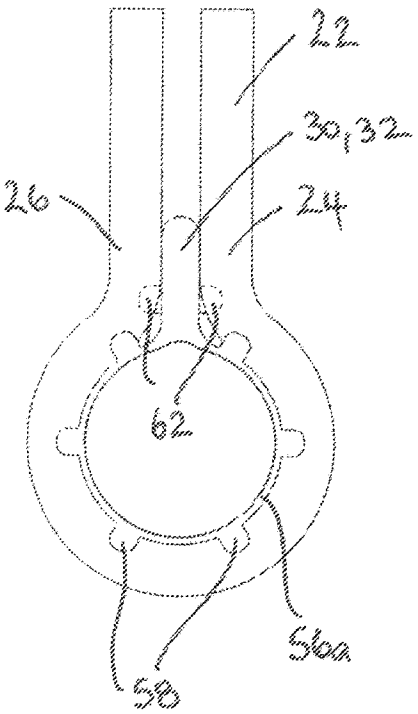
FIG. 8 is an axial view of the radially deformable ring of FIGS. 7*a* and 7*b* with the flexible tubing located around the radially deformable ring.
Figure 7:
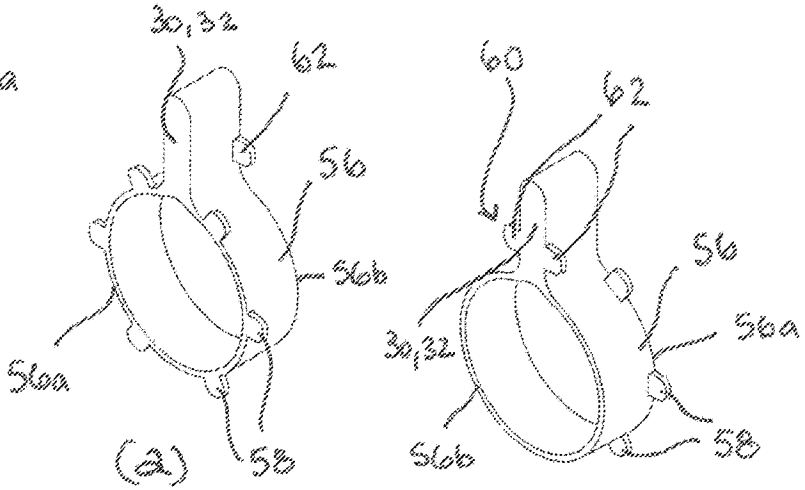
FIGS. 7*a* and 7*b* are perspective views showing the detail of the radially deformable ring shown in FIGS. 6*a* and 6*b;*
Figure 10:
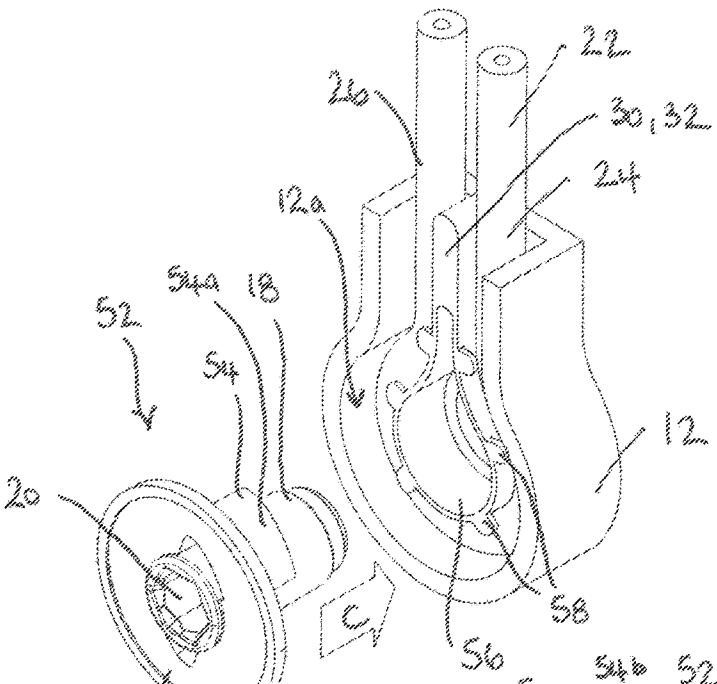
FIG. 10 is a perspective view showing the flexible tubing and radially deformable ring positioned in the cylindrical stator before the rotor is fitted in the cylindrical stator.
Figure 11:
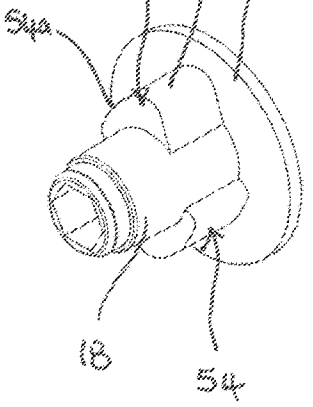
FIG. 11 is a detailed view of the rotor.

Referring in particular to FIGS. 7 and 8, the peristaltic pump 50 comprises a radially deformable ring 56 having a plurality of circumferentially-spaced radial projections 58 on a first axial rim 56*a*. The radial projections 58 project in a radially outward direction in use towards the inner wall 12*a* of the cylindrical stator 12. The rotor 52 includes a circular flange 52*a* which axially retains the flexible tubing 22 and the radially deformable ring 56 in the cylindrical stator 12. As best seen in FIGS. 12*a* and 12*b*, the radially deformable ring 56 is arranged in the cylindrical stator 12 of the peristaltic pump 50 with the radial projections 58 in contact with the circular flange 52*a*. The radial projections 58 act as plain bearing members or bearing flanges and space the flexible tubing 22 from the axially inner surface of the circular flange 52*a*. As noted above, this reduces or eliminates friction forces between the rotating circular flange 52*a* and the flexible tubing 22 as the rotor 52 rotates and prevents the flexible tubing 22 from being gripped and stretched by the circular flange 52*a*.

Although in the second embodiment the primary function of the radial projections 58 is to act as bearing members or bearing flanges, it will also be understood that the radial projections 58 assist with axial location and retention of the flexible tubing 22 on the radially deformable ring 56 in the same way as the locating projections 36 of the first embodiment.

In order to further assist with axial location and retention of the flexible tubing 22, the radially deformable ring 56 can optionally include a locating arrangement 60 on the second axial rim 56*b* (best seen in FIGS. 7 and 8). The locating arrangement 60 comprises a pair of oppositely extending locating projections 62 which extend from the ring anchor 30 over the inlet side 24 and the outlet side 26 of the flexible tubing 22.

Figure 9:
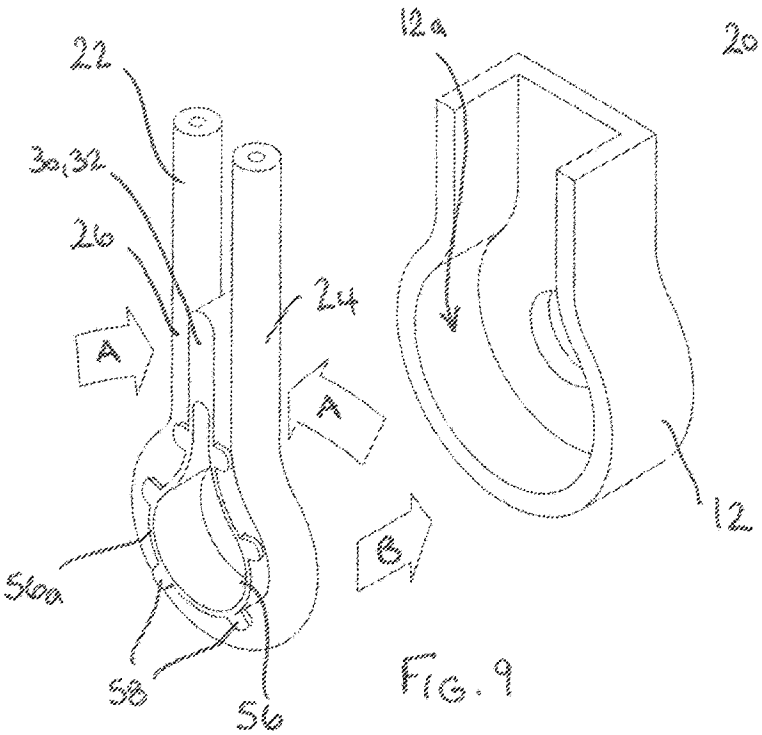
FIG. 9 is a perspective view showing the flexible tubing located around the radially deformable ring before being positioned in the cylindrical stator.
Figure 12:
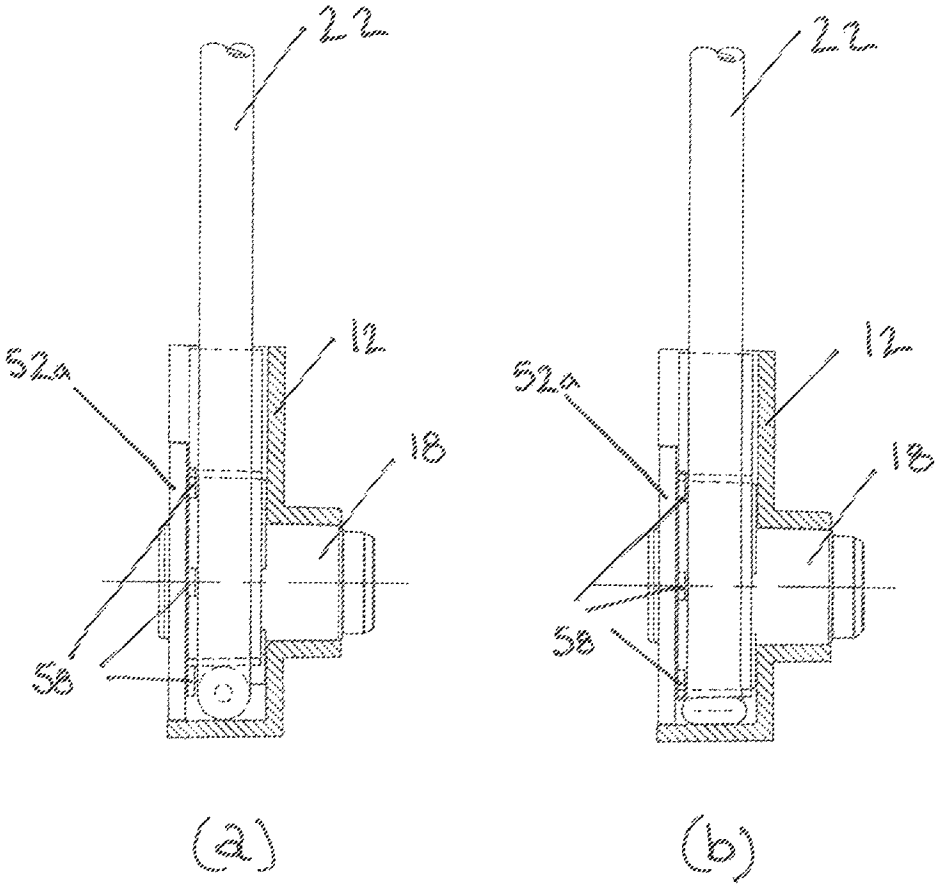
FIGS. 12*a* and 12*b* are cross-sectional views of the second embodiment with the rotor at different rotational positions.

The method of assembling the peristaltic pump 50 is essentially the same as the assembly method described above with reference to FIGS. 3 and 4. That is, the flexible tubing 22 is initially located around the deformable ring 56 as shown in FIG. 9 so that it contacts the radially outer surface of the deformable ring 56 and so that the inlet side 24 and the outlet side 26 of the flexible tubing 22 are arranged side-by-side on either side of the ring anchor 30. In this embodiment, the radial projections 58 and the locating projections 62 may help the user to locate the flexible tubing 22 around the deformable ring 56 and may help to prevent the flexible tubing 22 from slipping axially off the deformable ring 56 during assembly. The assembled flexible tubing 22 and deformable ring 56 are then compressed, for example by squeezing as shown diagrammatically by the arrows A, to a sufficient size to enable them to be pushed into the cylindrical stator 12 in the direction of the arrow B with the radial projections 58 uppermost.

Once the flexible tubing 22 and deformable ring 56 have been positioned in the cylindrical stator 12 as shown in FIG.

10, the rotor 52 can be fitted and this is achieved by pushing the rotor 14 into the centre of the deformable ring 56, as shown diagrammatically by the arrow C, and at the same time rotating the rotor 52 by a small amount as shown diagrammatically by the arrow D. Once the rotor 52 has been fitted into the centre of the deformable ring 56, the circular flange 52*a* contacts the radial projections 58 which, as explained above, act as bearing flanges which space the flexible tubing 22 from the circular flange 52*a*. Once assembled, the central drive aperture 20 can be engaged by an external rotary drive which can be operated to rotate the rotor 52.

Although exemplary embodiments have been described in the preceding paragraphs, it should be understood that various modifications may be made to those embodiments without departing from the scope of the appended claims. Thus, the breadth and scope of the claims should not be limited to the above-described exemplary embodiments. Each feature disclosed in the specification, including the claims and drawings, may be replaced by alternative features serving the same, equivalent or similar purposes, unless expressly stated otherwise.

For example, the rotor 14, 52 could include a projection in place of the central drive aperture 20 which could engage an aperture in a drive shaft of an external rotary drive.

Unless the context clearly requires otherwise, throughout the description and the claims, the words "comprise", "comprising", and the like, are to be construed in an inclusive as opposed to an exclusive or exhaustive sense; that is to say, in the sense of "including, but not limited to".

Any combination of the above-described features in all possible variations thereof is encompassed by the present invention unless otherwise indicated herein or otherwise clearly contradicted by context.

The invention claimed is:

1. A peristaltic pump comprising:

a drivable rotor having at least one pressing member;

a cylindrical stator in which the rotor is rotatable;

flexible tubing having an inlet side and an outlet side, the flexible tubing extending circumferentially around the stator against an inner wall;

a radially deformable ring positioned between the rotor and the circumferentially extending flexible tubing, the ring being deformable by the at least one pressing member upon rotation of the rotor to compress the flexible tubing against the inner wall of the cylindrical stator to thereby convey liquid along the flexible tubing;

wherein the radially deformable ring includes a ring anchor;

wherein the inlet side and the outlet side of the flexible tubing are arranged side-by-side so that the flexible tubing extends in a substantially radial direction outwardly away from the cylindrical stator, and the ring anchor projects radially outwardly from the radially deformable ring and is located between, and gripped by, the inlet side and the outlet side of the flexible tubing whereby a gripping force is applied directly to the ring anchor by opposing surfaces of the inlet side and the outlet side of the flexible tubing to prevent rotation of the radially deformable ring during rotation of the rotor.

2. A pump according to claim 1, wherein the ring anchor comprises a finger projecting radially outwardly from the radially deformable ring.

3. A pump according to claim 1, wherein the radially deformable ring has an axial depth which is greater than an outer diameter of the flexible tubing.

4. A pump according to claim 1, wherein the radially deformable ring includes a plurality of circumferentially-spaced radial projections on a first axial rim which project in a radially outward direction towards the inner wall of the cylindrical stator.

5. A pump according to claim 4, wherein the rotor includes a circular flange which axially retains the flexible tubing and the radially deformable ring in the cylindrical stator and wherein the radially deformable ring is arranged in the stator with the radial projections in contact with the circular flange.

6. A pump according to claim 1, wherein the radially deformable ring includes a locating arrangement, on a second axial rim, which extends from the ring anchor over the inlet side and the outlet side of the flexible tubing.

7. A pump according to claim 6, wherein the locating arrangement comprises a locating flange.

8. A pump according to claim 6, wherein the locating arrangement comprises a pair of oppositely extending locating projections.

9. A pump according to claim 1, wherein the rotor includes a plurality of pressing members which are equispaced around the circumference of the rotor.

10. A pump according to claim 1, wherein the rotor includes a spindle and each of the at least one pressing member is integrally formed with the spindle.

11. A pump according to claim 1, wherein each of the at least one pressing member is a lobe.

12. A pump according to claim 11, wherein the lobe has an arcuate pressing surface which is arranged to progressively compress the flexible tubing against the inner wall of the cylindrical stator during rotation of the rotor.

13. A pump according to claim 12, wherein the lobe has an apex at which the arcuate pressing surface terminates, the apex being arranged to fully compress the flexible tubing against the inner wall of the cylindrical stator.

14. A pump according to claim 12, wherein the rotor includes two of said lobes at diametrically opposite locations.

15. A pump according to claim 1, wherein the rotor is engageable by an external rotary drive.

16. A method for assembling a peristaltic pump according to claim 1, the method comprising:

locating the flexible tubing circumferentially around the radially deformable ring and in contact therewith, with the inlet side and the outlet side of the flexible tubing arranged side-by-side on either side of the ring anchor;

positioning the flexible tubing and the radially deformable ring in the cylindrical stator with the flexible tubing arranged against the inner wall of the cylindrical stator; and fitting the rotor in the cylindrical stator by simultaneously rotating the rotor and pressing the rotor into the centre of the radially deformable ring.

* * * * *